US006012536A

United States Patent [19]

Püttmann et al.

[11] Patent Number: 6,012,536

[45] **Date of Patent: *Jan. 11, 2000**

[54] METHOD FOR STEERING A GROUND-DRILLING MACHINE

[75] Inventors: Franz-Josef Püttmann; Alfons Hesse, both of Lennestadt, Germany

[73] Assignee: Tracto-Technik Schmidt Spezialmaschinen, Lennestadt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/799,395

[22] Filed: Feb. 12, 1997

[30] Foreign Application Priority Data

Feb. 27, 1996 [DE] Germany ..... 196 07 365

[51] Int. Cl.[7] ..... E21B 7/26

[52] U.S. Cl. ..... 175/21; 175/45; 175/61; 175/103

[58] Field of Search ..... 175/21, 45, 61, 175/103

[56] References Cited

U.S. PATENT DOCUMENTS

| | | | |
|---|---|---|---|
| 4,679,637 | 7/1987 | Cherrington et al. | 175/61 |
| 4,834,193 | 5/1989 | Leitko et al. | 175/19 |
| 4,867,255 | 9/1989 | Baker et al. . | |
| 4,907,658 | 3/1990 | Stangl et al. | 175/19 |
| 4,936,708 | 6/1990 | Perry . | |
| 5,288,173 | 2/1994 | Jenne et al. . | |
| 5,322,391 | 6/1994 | Fisk . | |
| 5,339,909 | 8/1994 | Jenne et al. . | |
| 5,449,046 | 9/1995 | Kinnan . | |
| 5,492,184 | 2/1996 | Jenne . | |

FOREIGN PATENT DOCUMENTS

| | | |
|---|---|---|
| 0 204 474 | 12/1986 | European Pat. Off. . |
| 0 245 971 | 11/1987 | European Pat. Off. . |
| 0 530 045 | 3/1993 | European Pat. Off. . |
| 44 33 533 | 11/1995 | Germany . |

*Primary Examiner*—Roger Schoeppel
*Attorney, Agent, or Firm*—Merchant & Gould P.C.

[57] ABSTRACT

The invention pertains to a method for steering a ground drilling machine, in particular, a pipe string assembly with a drilling head which is driven in the ground in rotative, propulsive and, if so desired, percussive fashion, in which at least one deflection pulse is exerted upon the rotating drilling head or the pulses acting upon the drilling head are interrupted when the angular position of the drilling head relative its axis corresponds to the position in which the deflection should take place.

29 Claims, 6 Drawing Sheets

METHOD FOR STEERING A GROUND-DRILLING MACHINE

BACKGROUND OF THE INVENTION

The invention pertains to a method for steering a ground-drilling machine, in particular, a drill column assembly with a drilling head which is driven in the ground in rotative, propulsive and, if so required, percussive fashion.

In one known method for steering a drilling machine, the drilling head has a beveled surface that causes a deflection of the machine if the rotation of the drilling head is interrupted.

In order to determine the position of the drilling head in the ground, a transmitter that, for example, is supplied with energy via batteries is arranged in the drilling head. This transmitter comprises measuring devices that make it possible to measure the depth of the drilling head, the position of the drilling head in the ground as well as the incline and the roll-off of the drilling head relative to its axis, i.e., the angular position of the beveled surface relative to the longitudinal axis. In addition, it is also possible to determine the temperature of the drilling head.

The measured data is transmitted from the transmitter arranged in the drilling head to a receiver on the surface and displayed at this location. Subsequently, the data is transmitted in wireless fashion to the operator of the rotation and propulsion unit and also displayed at this location. This data makes it possible to initiate a steering maneuver, e.g., by interrupting the rotation of the pipe string assembly in a certain angular position of the beveled surface which corresponds to the position, in which the deflection should take place. In this position, the pipe string assembly with the drilling head is only driven in translational (propulsive or percussive) fashion such that the beveled surface generates a lateral force that causes a steering movement.

FIG. 1 shows how a conventional steering maneuver is carried out if the pipe string assembly should extend along a road curve that, for example, has a curvature radius of 60 m. A straight hole 1 should continue at a predetermined radius of curvature beginning at a point 2. The rotation of the pipe string assembly is interrupted by a control signal in position 2 such that the drilling head is deflected in the desired direction over a section 3. However, this deflection corresponds to the maximum deflection that can be attained with the beveled surface of the drilling head, i.e., the rotation of the pipe string assembly must be resumed via a control signal in position 4 so as to realize the ensuing linear section 1. The rotation of the pipe string assembly or the drilling head, respectively, neutralizes the effect of the beveled surface of the drilling head. Consequently, it is necessary to interrupt the rotation of the pipe string assembly anew and initiate another deflection of the pipe string assembly after a certain distance.

Due to this phased interruption of the pipe string assembly, the hole in the ground extends in zigzag fashion, i.e., the pipe string assembly is subjected to intense stresses because it must follow this zigzag-shaped progression. In addition, it is possible for the drilling head to become jammed in the ground during longer steering movements, i.e., while the pipe string assembly does not rotate. This means that the pipe string assembly can resume its rotation after the steering movement is completed only if the torque is increased, i.e., the pipe string assembly is subjected to very high peak stresses.

This situation remains the same if dynamic percussions generated by a percussion unit are exerted upon the pipe string assembly in addition to the static propulsion generated by the rotation and propulsion unit. This percussion unit which, for example, acts upon the drilling head via the pipe string assembly or is directly arranged on the drilling head, makes it possible to carry out steering movements during the advance of the drilling head in hard, dense soils.

In order to improve the earth-removal effect of the drilling head, it is conventional to supply a fluid, in particular, a bentonite suspension, to the drilling head via a tubular pipe string assembly. This fluid is discharged from nozzles on the drilling head in the form of a cutting jet that serves for loosening the soil and/or improving the removal of the loosened soil as well as cooling the drilling head and the locating and transmission device.

Instead of transmitting the measured data from the transmitter to a receiver on the surface in wireless fashion and forwarding said data from this receiver to the operator of the rotation and propulsion unit, it is also conventional to transmit the data from the measuring system in the drilling head that may also contain the energy supply for the measuring system to the rotation and propulsion unit via a cable that extends through the pipe string assembly and display the measured data at this location. This technique of transmitting the data by means of a cable is utilized particularly in instances in which it is not possible to walk on the surface within the region of the hole.

SUMMARY OF THE INVENTION

The invention is based on the objective of developing a method and a device for steering a ground-drilling machine that is driven in the ground in rotative, propulsive and, if so desired, percussive fashion which eliminate the disadvantages of known steering methods and allow a continuous steering process.

The solution to this objective is based on the idea of carrying out the steering of, for example, a drilling head with a beveled surface in the form of small steering increments or steering pulses and not over a certain duration as is the case with conventional methods. In this manner, a steering movement is possible while the drilling head, e.g., a drilling head with a beveled surface, is rotating.

According to the invention, one or more deflection pulses are exerted upon the rotating drilling head when the angular position of the drilling head relative to its axis corresponds to the position in which the deflection should take place. Suitable steering pulses are percussion or propulsion pulses or fluid pulses if steering nozzles are arranged on the drilling head. In this case, one or more fluid pulses are triggered when the effective direction of the nozzles corresponds to the position, in which the deflection should take place.

Percussion pulses may be used as steering pulses if steering elements are arranged on the drilling head. In this case, one or more percussion pulses are exerted upon the steering element when the angular position of the steering elements corresponds to the position in which the deflection should take place.

In a pipe string assembly that is driven in rotative, propulsive and percussive fashion and comprises a drilling head with steering elements, the position of which is externally monitored, it is, in contrast, also possible to cause a corresponding deflection by interrupting the percussion pulses acting upon the drilling head when the angular position of the drilling head relative to its axis corresponds to the position in which the deflection should take place.

The steering movement also may be realized by means of fluid pulses if a pipe string assembly that is driven in the ground in rotative, propulsive and, if so required, percussive fashion and comprises a drilling head with fluid nozzles arranged thereon is controlled in such a way that certain regions of the fluid jets emerging from the fluid nozzles are interrupted when the angular position of the drilling head relative to its axis corresponds to the position, in which the deflection should take place.

In all possible options of the method according to the invention, the rotation of the pipe string assembly no longer must be interrupted in order to carry out a steering maneuver, i.e., the propulsion generated by the rotation and propulsion unit or the percussions generated by a percussion unit become more effective and no static friction occurs. In addition, it is no longer possible for the drilling head to become jammed in the hole.

The steering process is significantly simplified because continuous steering is possible without having to interrupt the rotation of the pipe string assembly or the drilling head. In addition, the steering process no longer must be carried out in phases. This means that the course of the hole also continuously curves because the method according to the invention proposes that, if the steering process is realized by means of a percussion unit, the drilling head is only advanced by a few millimeters during each percussion cycle as compared to known steering methods in which the drilling head is advanced by several centimeters without being rotated.

In addition, the earth-removal effect is improved because the rotation of the pipe string assembly or the drilling head no longer must be interrupted during a steering maneuver.

A device for steering a pipe string assembly that is driven in the ground in rotative and propulsive fashion by means of a rotation and propulsion unit and, if so desired, in percussive fashion may, according to the invention, comprise a steering element on the drilling head, a percussion unit on the drilling head or on the rotation and propulsion unit, and control elements for the percussion unit so as to exert a steering pulse upon the steering element or, if the pipe string assembly is also driven in percussive fashion, interrupt the percussion pulses when the angular position of the steering element corresponds to the position in which the deflection should take place. In the device according to the invention, the percussion unit may act upon the drilling head directly or indirectly via the pipe string assembly.

The steering element on the drilling head may consist of a beveled surface or a steering element that laterally protrudes from the drilling head due to a percussion effect. The percussion unit may act upon the steering element directly or indirectly via the pipe string assembly. In this case, the steering element generates forces that are directed perpendicular to the hole axis in order to deflect the drilling head into a curved path.

When using a percussion unit that directly acts upon the drilling head or the steering element in the drilling head, the percussion unit may consist of a pneumatically or hydraulically driven ram-drilling machine.

When using a percussion unit that indirectly acts upon the drilling head or the steering element in the drilling head via the pipe string assembly, said percussion unit may be integrated into the rotation and propulsion unit. In this case, the structural size of the percussion unit is insignificant, which is quite important if the drilling head has very small dimensions. In addition, the pipe string assembly may be realized in the form of a double pipe string assembly, i.e., the outer pipe string assembly can be used by the rotation and propulsion unit, and the inner pipe string assembly can be used for transmitting percussion pulses.

In a device for steering a pipe string assembly with a drilling head that is connected to the pipe string assembly without rotational play and comprises fluid nozzles on the drilling head and is driven in the ground in rotative and propulsive fashion by means of a rotation and propulsion unit and, if so required, in percussive fashion by means of a percussion unit, control elements for the emerging fluid may trigger one or more fluid pulses, if the fluid nozzles are asymmetrically arranged on the drilling head, or said control elements may, if the fluid nozzles are symmetrically arranged on the drilling head, interrupt certain regions of the fluid emerging from the nozzles when the angular position of the drilling head corresponds to the position, in which the deflection should take place.

If the fluid nozzles are arranged asymmetrically, said fluid nozzles may be arranged on one side of the drilling head. In a drilling head with a beveled surface which acts eccentrically, these fluid nozzles may, in particular, be arranged on the side of the drilling head which is situated opposite to the beveled surface.

If the drilling head comprises fluid nozzles that are uniformly distributed on the drilling head, the fluid nozzles may be selectively controlled by controllable valves. The valves may be arranged outside of the pipe string assembly within the region of the rotation and propulsion unit, but require several fluid lines from the valves to the fluid nozzles. Consequently, the valves in the drilling head should be arranged in the vicinity of the fluid nozzles, with a collective line leading to these valves, and with the valves being controlled via control lines that extend through the pipe string assembly or by the measuring device in the drilling head.

BRIEF DESCRIPTION OF THE DRAWINGS

The invention is described in detail below with reference to several embodiments that are illustrated in the figures. The figures show.

DETAILED DESCRIPTION

Figure 1:
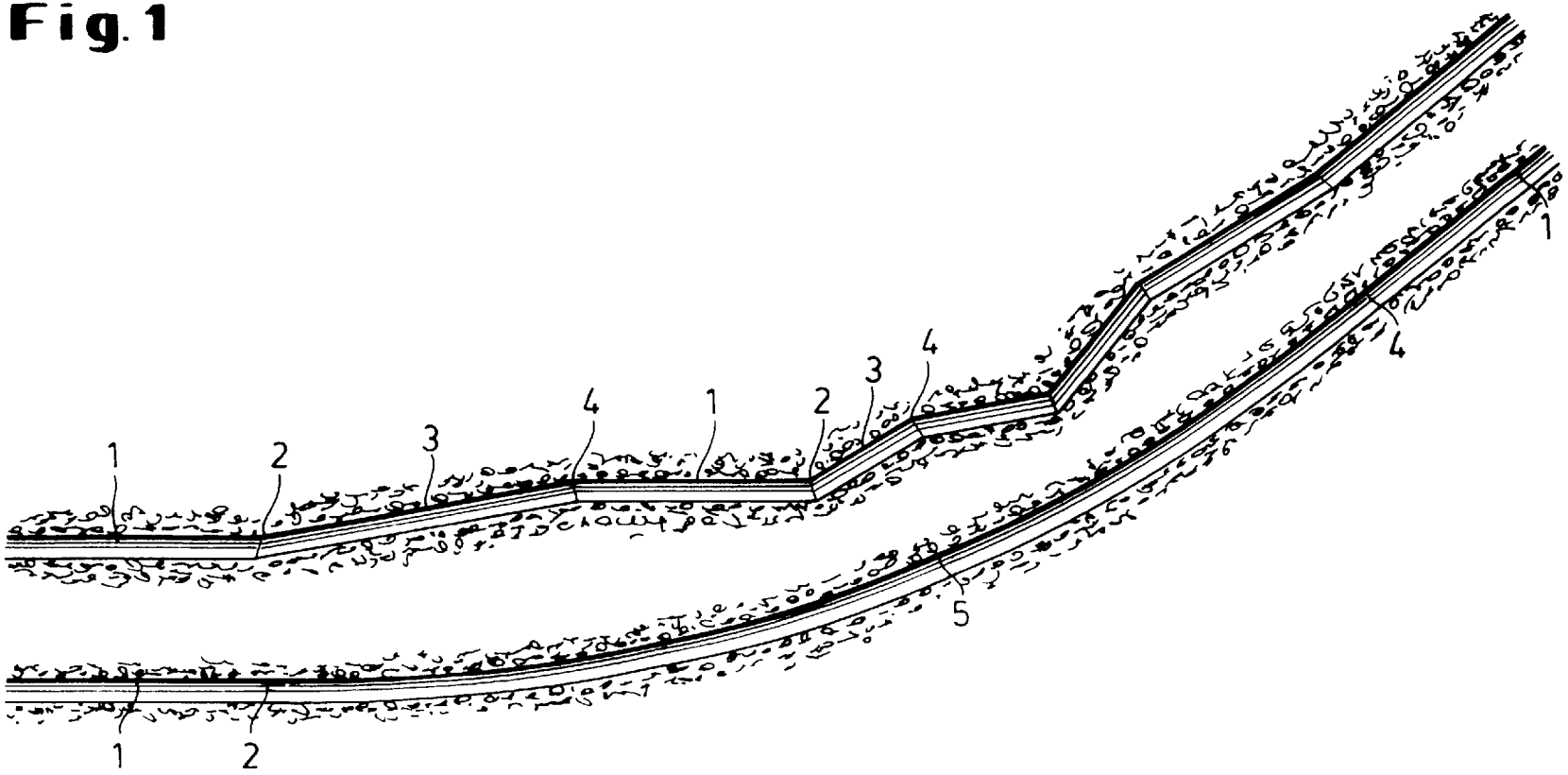
FIG. 1, the course of a hole produced with a conventional steering method and the course of a hole produced with the steering method according to the invention.

FIG. 1 shows that a hole produced with the known steering method consists of a linear section 1 that transforms into a curved section 3 because a control signal is delivered to a rotation and propulsion unit in position 2 so as to interrupt the rotation of the pipe string assembly. The rotation of the pipe string assembly resumes in position 4, i.e., a straight hole section 1 is produced after the curved section. In order to produce an arc with a predetermined radius, linear and curved sections alternately follow one another. Theoretically, the smallest attainable radius is realized if the rotation of the pipe string assembly is interrupted for an extended period of time such that a hole with the radius of the arc section is produced.

When drilling a curved section without rotating the drilling head, problems arise because the pipe string assembly and the device only move through the soil in propulsive fashion and significant frictional forces occur. These problems cannot be eliminated by subjecting the pipe string assembly to percussions. The non-rotating drilling head can become jammed in the soil, i.e., it is difficult to resume the rotational movement without damaging the pipe string assembly.

The curved section of a hole produced with the method of the invention extends continuously, e.g., when a straight hole 1 transforms into a curved section 5 in position 2. The curved section has a constant radius until a control signal stops the steering process in position 4 such that a straight hole 1 is produced again after the curved section. The curved hole 5 is produced while the pipe string assembly or the drilling head rotates, i.e., the problems of conventional steering methods are eliminated. Due to the continuous steering process, the method of the invention is significantly less damaging to the rod assembly.

Figure 2:
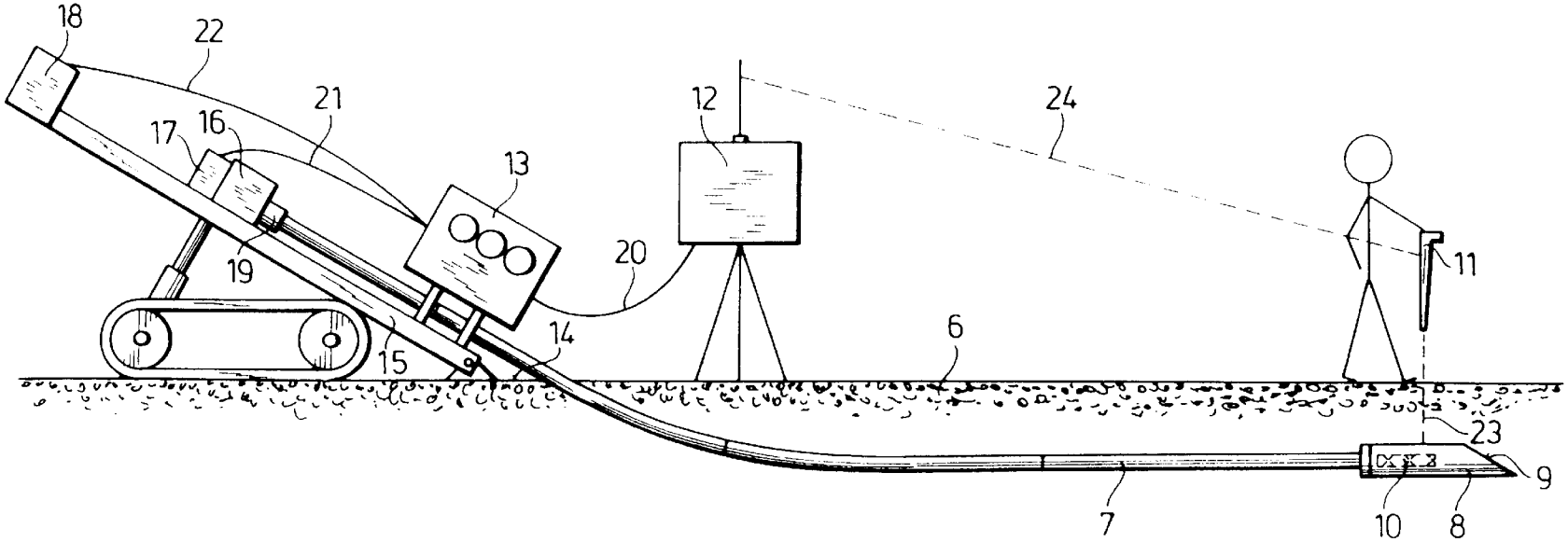
FIG. 2, a device for producing a hole with the aid of a drilling head arranged on a column assembly.

FIG. 2 shows that a hole in the soil 6 is produced by means of a pipe string assembly 7 that consists of individual pipes. A drilling head 8 with a beveled surface 9, which is preferably connected to the pipe string assembly 7 without rotational play, is situated on the end of the pipe string assembly 7. A transmitter 10 that transmits data to a receiver 11 in wireless fashion is arranged in the drilling head 8. This data contains information pertaining to the depth of the drilling head below the surface, the location of the drilling head 8 in the soil, its incline, the angular position of the steering surface 9 relative to the longitudinal axis of the drilling head 8 and, if so desired, the temperature of the drilling head 8. The radio connection between the transmitter 10 and the receiver 11 is indicated by the broken line 23.

An additional radio connection 24 serves for transmitting the aforementioned data from the receiver 11 to a display device 12 situated in the vicinity of a percussive rotation and propulsion unit 15 that is arranged at the starting point 14. This rotation and propulsion unit 15 comprises a rotary drive unit 16 for the pipe string assembly, a percussion unit 17 that acts upon the pipe string assembly 7 and a propulsion unit 18. The pipe string assembly 7 is coupled to the rotation and propulsion unit via a pipe string assembly connection 19.

A cable connection 21, 22 leads from the display device 12 to a switch box 13 with a control panel which makes it possible to control the rotary drive unit 16, the percussion unit 17 and the propulsion unit 18.

The device shown in FIG. 2 can be steered by two different methods. If the pipe string assembly 7 is only driven through the soil 6 in rotative and propulsive fashion, a straight hole is produced. In this case, the possible deflection of the eccentrically acting drilling head 8 caused by the steering surface 9 on the drilling head is neutralized by the constant rotation of the pipe string assembly 7. A steering movement can be realized when the percussion unit 17 is actuated once the steering surface 9 is situated in an angular position relative to the axis of the pipe string assembly 7 which corresponds to the desired direction of deflection. This means that at least one percussion pulse is exerted upon the pipe string assembly 7 via the percussion unit 17 during the uninterrupted rotation of the pipe string assembly 7 when the steering surface 9 on the drilling head is situated in the angular position required for the desired change in direction. The smallest radius can be attained if at least one percussion pulse is delivered during each revolution of the pipe string assembly 7 in the critical angular position. The arc radius becomes larger if a percussion pulse is only exerted upon the pipe string assembly 7 during each second or each third revolution.

A steering movement of the device shown in FIG. 2 also can be realized if the pipe string assembly 7 is not only driven through the soil 6 in rotative and propulsive fashion, but also in percussive fashion. In this case, the percussion pulses generated by the percussion unit 17 are interrupted in the critical angular position of the steering surface 9 on the drilling head 8 because a brief deflection in the desired direction also occurs in this case.

Figure 3:
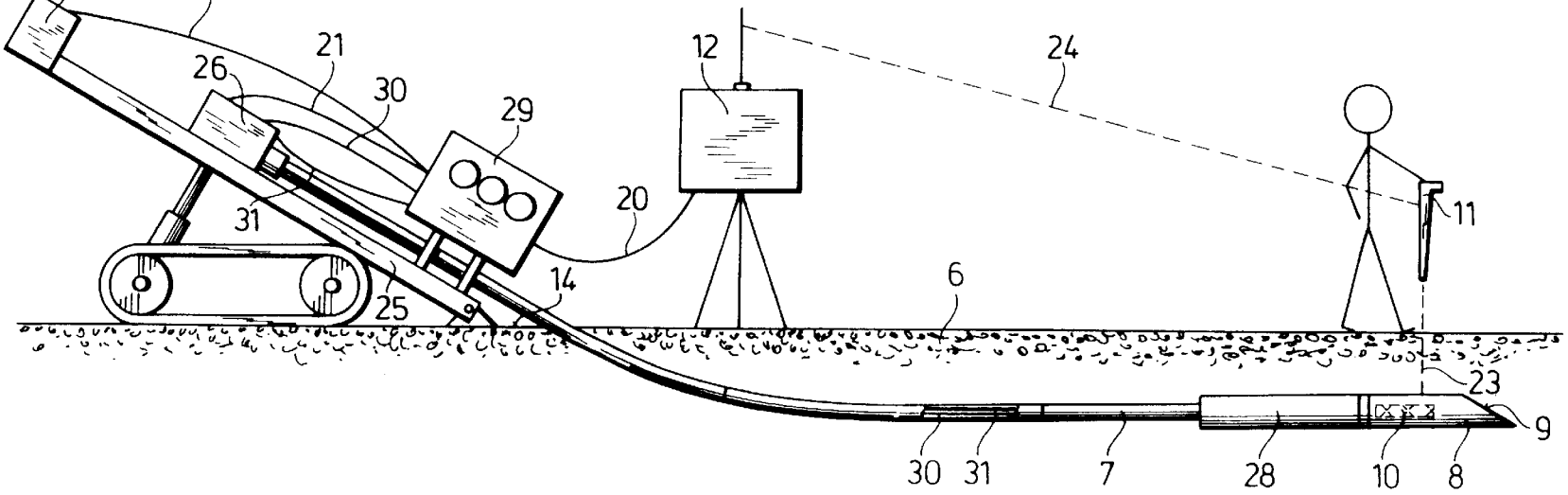
FIG. 3, a device for producing a hole with the aid of a percussion unit or pulsed propulsion unit arranged on a pipe string assembly.

The device shown in FIG. 3 consists of a rotation and propulsion unit 25 that comprises a rotary drive unit 26 and a propulsion unit 27. The drilling head with the steering surface 9 is directly arranged without rotational play on a percussion unit 28 that is preferably realized in the form of a pneumatically or hydraulically driven ram-drilling machine, and this percussion unit 28 is connected to the pipe string assembly 7 without rotational play.

A transmitter 10 that is connected to the receiver 11 via a radio connection 23 is situated in the drilling head 8. A radio connection 24 transmits the received data to a display device 12. The display device 12 is, as described previously, connected via a cable 20 to a switch box 29 that comprises a control panel. Cables 21, 22 lead from the switch box 29 to the rotary drive unit 26 and the propulsion unit 27. In addition, an energy supply line 40 leads from the switch box 29 to the percussion unit 28 through the rotary drive unit 26 and the pipe string assembly 7. The energy supply line 30 may consist of a hydraulic hose if the percussion unit 28 is constituted of a hydraulically driven percussion unit. A control line 31 that serves for activating and deactivating the percussion unit 28 runs parallel to the energy supply line 30.

The drilling heads can be steered with the device according to FIG. 3 in the same fashion as described previously with reference to the embodiment shown in FIG. 2.

Figure 4:
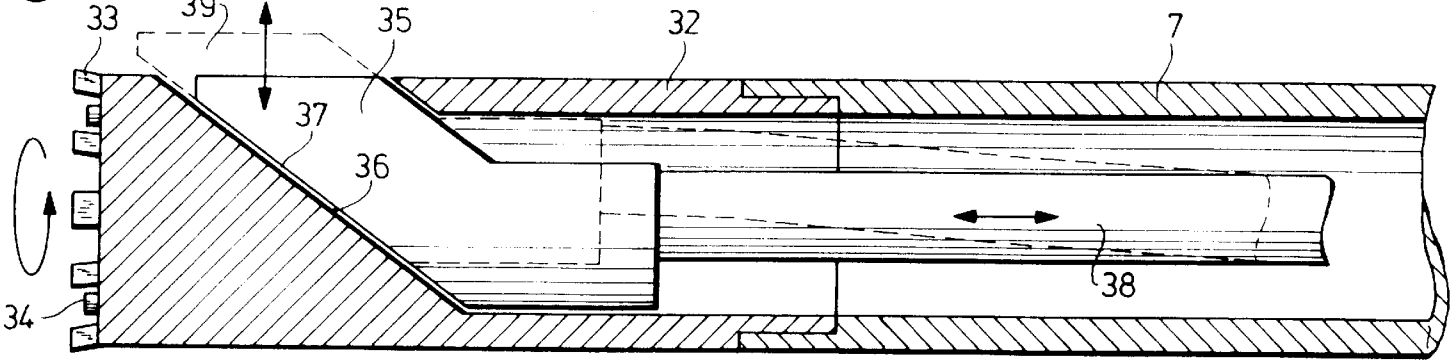
FIG. 4, a sectional representation of a drilling head.

The drilling head 32 shown in FIG. 4 comprises a drill bit 33 that is particularly suitable for breaking up rocks on its front end. Fluid nozzles 34 on the drilling head 32 serve to improve the earth-removal effect of the drilling head during the drilling process and the steering maneuver, transporting away the loosened material and cooling the drilling head.

A steering element 35 is arranged in the drilling head 32. This steering element comprises a wedge surface 37 that can be displaced on a wedge surface 36 of the drilling head 32 in such a way that a lateral projection 39 protrudes from the drilling head 32. For this purpose, the steering element 35 is connected to an inner pipe string assembly 38 that extends in the pipe string assembly 7. The percussion unit 17 and/or a propulsion unit acts upon this inner pipe string assembly 38 within the region of the rotation and propulsion unit 15 once a steering maneuver is initiated. Due to the pulses, the steering element 35 temporarily protrudes laterally from the drilling head 32 (shown in broken lines) and thus causes a steering pulse similar to that caused by the steering surface 9 on the drilling head 8 according to FIGS. 2 and 3. The laterally protruding steering projection 39 is only effective in the angular position of the drilling head 32 in which a steering maneuver should be executed. However, it is also possible to retract an extended steering projection in a certain angular position.

Naturally, the percussion unit may simultaneously act upon the drilling head 32 in order to improve the earth-removal effect of the drill bit 33; it is also possible to directly arrange a percussion unit on the drilling head 32 or to arrange a ram-drilling machine within the region of the drilling head 32 in order to actuate the steering element 35, with the percussion unit 17 on the turning and propulsion unit 15 according to FIG. 2 being used for exerting percussion pulses upon the drill bit 33 via the pipe string assembly 7.

Figure 5:
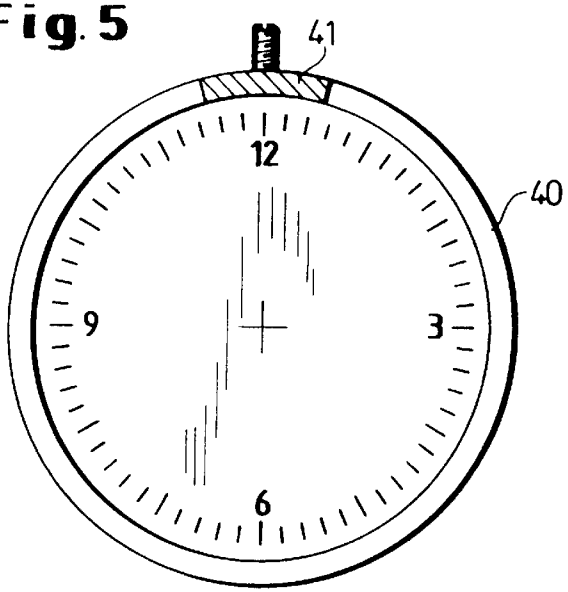
FIG. 5, an angle sensor for controlling the angular position during the steering of the pipe string assembly.

FIG. 5 shows an angle sensor 40 that is realized in the form of a dial face in order to visibly display the angular position of the steering elements. If a trigger 48 on the angle transmitter 40 is adjusted to the desired angular position (time), the percussion units described previously with reference to FIGS. 2–4 are only controlled in this angular position and thus cause a corresponding steering movement.

Figure 6:
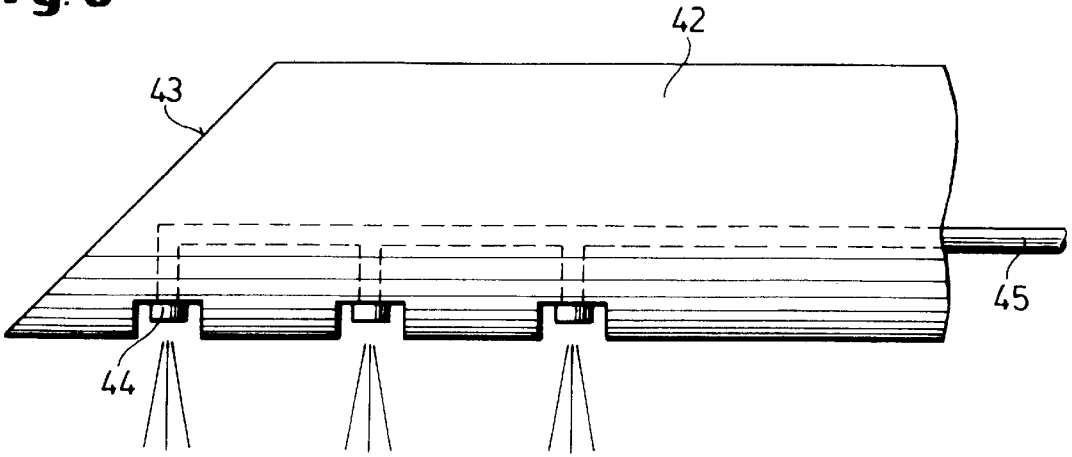
FIG. 6, an eccentrically acting drilling head with steering nozzles.

In the embodiment shown in FIG. 6, the drilling head 42 that is driven in rotative and propulsive fashion comprises a beveled surface 43 and fluid nozzles 44 that are arranged on the side of the drilling head 42 situated opposite to the beveled surface 43. These fluid nozzles 44 are supplied with a high-pressure fluid via a fluid line 45. If the compressed fluid is supplied when a steering pulse is required or if the continuous supply of fluid is briefly interrupted in a certain angular position of the drilling head 42, a steering pulse is generated which makes it possible to adjust the radius of the hole.

Figure 7:
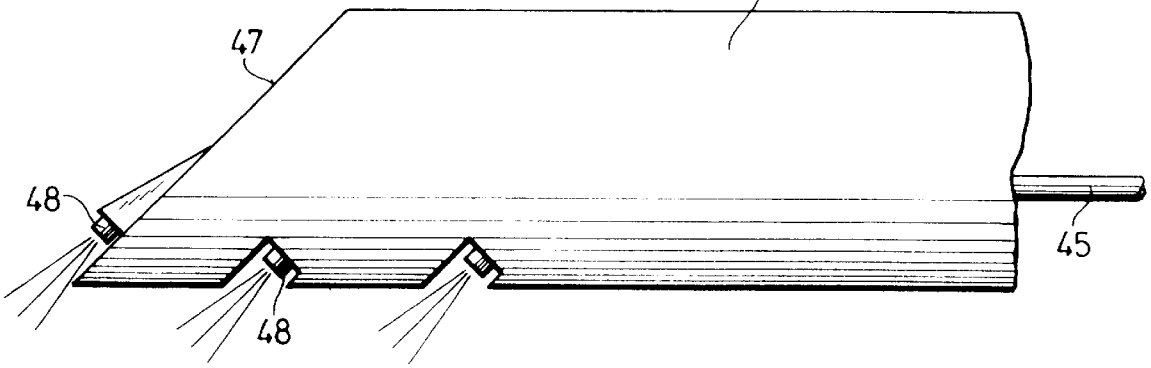
FIG. 7, a drilling head with a nozzle in the beveled surface.

The embodiment according to FIG. 7 merely differs from the embodiment according to FIG. 6 due to the fact that the fluid nozzles 48 are not arranged perpendicular, but rather transversely relative to the longitudinal axis of the drilling head 46, with one fluid nozzle being arranged on the beveled surface 47.

Figure 8:
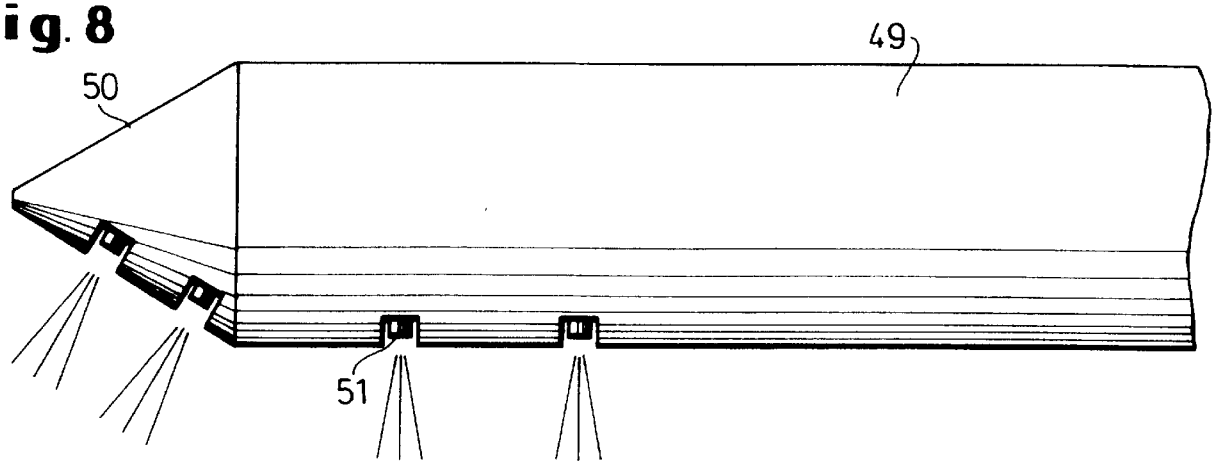
FIG. 8, a centrally acting drilling head with eccentrically acting steering nozzles, and FIG. 9, a drilling head with uniformly distributed steering nozzles.

The drilling head 49 shown in FIG. 8 is provided with a centrally acting drill bit 50, and a series of steering nozzles 51 are arranged in the drill bit 50 and in the outer surface of the drilling head 49. In this drilling head 49, a steering pulse is either generated by supplying fluid to the nozzles 51 in a certain angular position of the drilling head 49 or by interrupting the supply of fluid in a certain angular position if the fluid nozzles 51 are continuously supplied with fluid.

Figure 9:
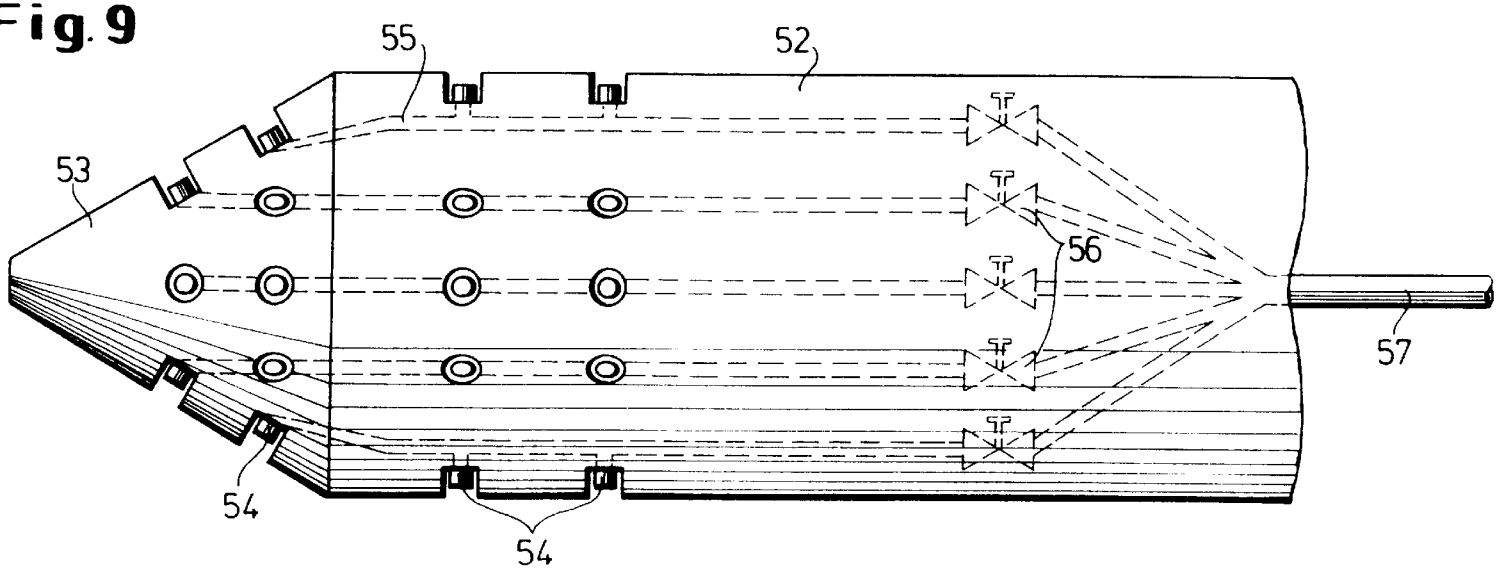

In the embodiment according to FIG. 9, fluid nozzles 54 are uniformly distributed on the circumference of a drilling head 52 with a conical tip 53. Several fluid nozzles 54 that are arranged flush in the longitudinal direction of the drilling head 52 are respectively connected to a remote-controlled valve 56 via a line 55. A collective line 57 leads to a rotation and propulsion unit. Each remote-controlled valve 56 is connected to the control device of the rotation and propulsion unit via a control line (not shown) such that a series of fluid nozzles 54 can be charged with fluid or the supply of fluid to said fluid nozzles can be interrupted if a steering maneuver must be initiated. In this embodiment, the steering pulses are not delivered during each revolution of the pipe string assembly as in the embodiments according to FIGS. 1–8, but a steering pulse is triggered each time a series of fluid nozzles 54 assumes the correct angular position. These measures allow a particularly sensitive steering of the pipe string assembly.

When steering the pipe string assembly by means of fluid nozzles, it is possible to arrange nozzles that are continuously charged with fluid and behave neutrally with respect to the steering process on the drilling head, with additional nozzles causing the fluid pulses for the steering maneuver. In this case, the nozzles may be supplied with fluid via different pipelines, e.g., the neutral nozzles are supplied via an outer pipe string assembly and the steering nozzles are supplied via an inner pipe string assembly. In addition, it is also possible to charge the steering nozzle with a low fluid pressure while drilling straight and with a high pressure in the predetermined angular position. The pressure pulse can also be realized by causing a remote-controlled, pulse-like narrowing of the fluid nozzle cross section.

Electromagnetic valves serve to actuate the percussion unit 17 on the rotation and propulsion unit 15 or the ram-drilling machine 28, respectively, and for supplying the fluid nozzles with fluid. However, it is also possible to utilize a mechanically driven cam actuator that is connected to the pipe string assembly connection 19 on the rotation and propulsion unit 15 or 25, respectively. Such a cam actuator may actuate a switch for the percussion unit 17 or the percussion unit 28 in the predetermined angular position. Naturally, such a cam actuator may also be arranged on the front of the drilling head if the percussion unit is arranged on the front of the pipe string assembly. Since the steering pulse is generated with a certain delay after the time at which the angular position of the drilling head is measured, it is advantageous to design the control to take the pulse transmission time into consideration.

This is particularly important if the angular position of the drilling head is not determined by a sensor 10, but rather by a sensor arranged on the pipe string assembly connection 19. In this case, the torsion of the pipe string assembly caused by the rotational resistance of the drilling head and the friction of the pipe string assembly 7 in the hole must be taken into consideration in accordance with the length of the pipe string assembly 7. When using a double pipe string assembly or a single pipe string assembly with an inserted torsion rod, it may be very advantageous to measure the angular position directly on the hole carriage, namely by the pipe string assembly or the torsion rod which are not subjected to torsion or only subjected to slight torsion. Consequently, it is very simple to generate corresponding pulses via a cam control.

We claim:

1. A method for steering an underground drilling machine, comprising:

continuously rotating a drilling head connected to a pipe string assembly, the drilling head comprising a forward steering surface that is inclined relative to a longitudinal axis of the drilling head so as to not allow rotation therebetween; and applying to the rotating drilling head a steering pulse at a desired position in the rotation of the drilling head to cause a travel direction of the drilling head to change from a travel direction before the pulse is applied.

2. The method according to claim 1, wherein the steering pulse is percussive.

3. The method according to claim 1, wherein the steering pulse is propulsive.

4. The method according to claim 1, wherein the drilling head comprises a fluid nozzle in communication with a compressed fluid source, and the steering pulse is exerted by the compressed fluid through the fluid nozzle.

5. A method for steering an underground drilling machine, comprising:

continuously rotating a drilling head connected to a pipe string assembly, the drilling head comprising a forward steering surface that is inclined relative to a longitudinal axis of the drilling head;

continuously applying to the rotating drilling head a steering pulse to cause the drilling head to travel in a straight line; and interrupting the steering pulse at a desired position in the rotation of the drilling head to cause a travel direction of the drilling head to change from a travel direction before the pulse is interrupted.

6. The method according to claim 5, wherein the steering pulse is percussive.

7. The method according to claim 5, wherein the steering pulse is propulsive.

8. The method according to claim 5, wherein the drilling head comprises a fluid nozzle in communication with a compressed fluid source, and the steering pulse is exerted by the compressed fluid through the fluid nozzle.

9. A method for steering an underground drilling machine, comprising:

continuously rotating a drilling head connected to a pipe string assembly, the drilling head comprising a retractable steering element capable of being extended from a first position to a second position radially outward from the first position; and moving the steering element with an axially-movable member, which extends through the pipe string, between the first and second positions at a desired position in the rotation of the drilling head to cause a travel direction of the drilling head to change from a travel direction before the position of the steering element is moved.

10. A steerable ground-drilling machine, comprising:

a rotatable drilling head connected to a pipe string and comprising a forward steering surface that is inclined relative to a longitudinal axis of the drilling head so as to not allow rotation therebetween;

an element for applying a steering pulse to the drilling head; and a control element for the steering pulse element, whereby the steering pulse is applied to the rotating drilling head at a desired position in the rotation of the drilling head to cause a travel direction of the drilling head to change from a travel direction before the pulse is applied.

11. The machine according to claim 10, wherein the steering pulse is percussive.

12. The machine according to claim 11, wherein a ram-drilling unit applies the percussive pulse.

13. The machine according to claim 10, wherein the steering pulse is propulsive.

14. The machine according to claim 10, wherein the drilling head comprises a fluid nozzle in communication with a compressed fluid source, and the steering pulse is exerted by the compressed fluid through the fluid nozzle.

15. The machine according to claim 10, further comprising a rotation and propulsion unit for driving the pipe string and drilling head.

16. The machine according to claim 15, wherein the rotation and propulsion unit further comprises a percussion unit for applying the steering pulse.

17. The machine according to claim 10, wherein the pipe string comprises concentric inner and outer members, the outer member driving the drilling head and the inner member delivering the steering pulse to the drilling head.

18. A steerable ground-drilling machine, comprising:

a rotatable drilling head connected to a pipe string and comprising a forward steering surface that is inclined relative to a longitudinal axis of the drilling head;

an element for applying a steering pulse to the drilling head continuously during rotation of the drilling head to cause the drilling head to travel in a straight line; and a control element for the steering pulse element, whereby the steering pulse is interrupted at a desired position in the rotation of the drilling head to cause a travel direction of the drilling head to change from a travel direction before the pulse is interrupted.

19. The machine according to claim 18, wherein the steering pulse is percussive.

20. The machine according to claim 19, wherein a ram-drilling unit applies the percussive pulse.

21. The machine according to claim 18, wherein the steering pulse is propulsive.

22. The machine according to claim 18, wherein the drilling head comprises a fluid nozzle in communication with a compressed fluid source, and the steering pulse is exerted by the compressed fluid through the fluid nozzle.

23. The machine according to claim 22, wherein the fluid nozzle is positioned on a surface of the drilling head opposite to the steering surface.

24. The machine according to claim 18, further comprising a rotation and propulsion unit for driving the pipe string and drilling head.

25. The machine according to claim 24, wherein the rotation and propulsion unit further comprises a percussion unit for applying the steering pulse.

26. The machine according to claim 18, wherein the pipe string comprises concentric inner and outer members, the outer member driving the drilling head and the inner member delivering the steering pulse to the drilling head.

27. A steerable ground-drilling machine, comprising:

a rotatable drilling head connected to a pipe string and comprising a retractable steering element capable of being extended from a first position to a second position radially outward from the first position; and an axially-movable control element, extending through the pipe string, for moving the steering element between the first and second positions at a desired position in the rotation of the drilling head to cause a travel direction of the drilling head to change from a travel direction before the position of the steering element is moved.

28. A steerable ground-drilling machine, comprising:

a rotatable drilling head connected to a distal end of a pipe string and comprising a steering element;

an element for applying a steering pulse to the drilling head;

a sensor adjacent a proximate end of the pipe string, determining an angular position of the rotatable drilling head; and a control element for the steering pulse element, whereby the steering pulse is applied to the rotatable drilling head at a desired angular position of the drilling head as determined by the sensor, to cause a travel direction of the drilling head to change from a travel direction before the pulse is applied.

29. A steerable ground-drilling machine, comprising:

a rotatable drilling head connected to a distal end of a pipe string and comprising a steering element;

an element for applying a steering pulse to the drilling head continuously during rotation of the drilling head to cause the drilling head to travel in a straight line;

a sensor adjacent a proximate end of the pipe string, determining an angular position of the rotatable drilling head; and a control element for the steering pulse element, whereby the steering pulse is interrupted at a desired angular position of the drilling head as determined by the sensor, to cause a travel direction of the drilling head to change from a travel direction before the pulse is interrupted.

* * * * *